US009485593B2

(12) United States Patent
Inagaki

(10) Patent No.: US 9,485,593 B2
(45) Date of Patent: Nov. 1, 2016

(54) ACOUSTIC DEVICE

(71) Applicant: KYOCERA CORPORATION, Kyoto (JP)

(72) Inventor: Tomohiro Inagaki, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/786,376

(22) PCT Filed: Apr. 23, 2014

(86) PCT No.: PCT/JP2014/062035
§ 371 (c)(1),
(2) Date: Oct. 22, 2015

(87) PCT Pub. No.: WO2014/175464
PCT Pub. Date: Oct. 30, 2014

(65) Prior Publication Data

US 2016/0088409 A1 Mar. 24, 2016

(30) Foreign Application Priority Data

Apr. 26, 2013 (JP) ..... 2013-094436

(51) Int. Cl.
*H04R 25/00* (2006.01)
*H04R 17/00* (2006.01)
*H04R 25/02* (2006.01)

(52) U.S. Cl.
CPC ..... *H04R 25/604* (2013.01); *H04R 17/00* (2013.01); *H04R 25/00* (2013.01); *H04R 25/02* (2013.01); *H04R 25/48* (2013.01); *H04R 2217/01* (2013.01); *H04R 2460/09* (2013.01)

(58) Field of Classification Search
CPC ..... H04R 17/00; H04R 25/02; H04R 25/48; H04R 25/604; H04R 2460/09
USPC ..... 381/173, 190, 191, 312, 322, 324, 328, 381/330, 381
See application file for complete search history.

(56) References Cited

U.S. PATENT DOCUMENTS 7,564,988 B2 * 7/2009 Azima ..... H04R 1/1075 381/330
8,521,239 B2 8/2013 Hosoi et al.
2009/0290730 A1 11/2009 Fukuda et al.
2012/0289162 A1 11/2012 Hosoi et al.

FOREIGN PATENT DOCUMENTS

JP 2003-264882 A 9/2003
JP 2006-304147 A 11/2006
(Continued)

OTHER PUBLICATIONS

International Search Report issued in Application No. PCT/JP2014/062035, mailed Jun. 22, 2014.
Written Opinion issued in Application No. PCT/JP2014/062035, mailed Jun. 22, 2014.

*Primary Examiner* — Brian Ensey
(74) *Attorney, Agent, or Firm* — Studebaker & Brackett PC

(57) ABSTRACT

This acoustic device can suppress a loss in sense of volume and sense of comfort. The acoustic device includes a vibration unit (10) including a piezoelectric element (101) that flexes and a panel (102) that vibrates by being bent directly by the piezoelectric element (101). The panel (102) includes a concavity (104), and the concavity (104) is contacted to a user's ear, causing the user to hear sound.

14 Claims, 10 Drawing Sheets

(56) References Cited

FOREIGN PATENT DOCUMENTS

| | | | |
|---|---|---|---|
| JP | 2007-103989 | A | 4/2007 |
| JP | 2007-165938 | A | 6/2007 |
| JP | 2009-302815 | A | 12/2009 |
| JP | 2012-204855 | A | 10/2012 |
| JP | 2013-078116 | A | 4/2013 |
| WO | 2008/029515 | A1 | 3/2008 |

* cited by examiner

ACOUSTIC DEVICE

CROSS-REFERENCE TO RELATED APPLICATION

This application claims priority to and the benefit of Japanese Patent Application No. 2013-94436 filed Apr. 26, 2013, the entire contents of which are incorporated herein by reference.

TECHNICAL FIELD

This disclosure relates to an acoustic device, such as a hearing aid.

BACKGROUND

In one type of acoustic device, such as an open fitting hearing aid, a vent connecting the inside of the external ear canal to the outside is provided to alleviate an occlusion effect when wearing the hearing aid (for example, see JP 2006-304147 A (PTL 1)). This type of hearing aid includes a microphone, an earphone, and a vent. The microphone collects sound from a sound source, and the earphone causes the user to hear the sound collected by the microphone. The vent is a hole connecting the inside of the external ear canal to the outside, as described above. As a result of the vent, the external ear canal is not completely sealed. Therefore, the occlusion effect that occurs when wearing the hearing aid is alleviated.

CITATION LIST

Patent Literature

PTL 1: JP 2006-304147 A

SUMMARY

Technical Problem

In this open fitting hearing aid, however, low-frequency sound among the sound produced by the earphone escapes to the outside through the vent. Therefore, the sound pressure of low-frequency sound decreases, impairing a sense of volume. Reducing the diameter of the vent in order to prevent low-frequency sound from escaping, however, brings about an occlusion effect, thereby impairing a sense of comfort when wearing the hearing aid.

It would therefore be helpful to provide an acoustic device that can suppress a loss in sense of volume and sense of comfort, two features which are difficult to combine.

Solution to Problem

In order to solve the above problem, an acoustic device according to this disclosure for causing a user to hear sound includes:

a vibration unit including a piezoelectric element that flexes and a panel that vibrates by being bent directly by the piezoelectric element, such that the panel includes a concavity, and the concavity is contacted to a user's ear.

In the acoustic device, the concavity in the panel may contact the user's tragus from outside the user's ear and transmit vibration of the panel to the tragus.

In the acoustic device, the concavity in the panel may contact the user's antitragus from outside the user's ear and transmit vibration of the panel to the antitragus.

In the acoustic device, a principal surface of the panel may include a portion that contacts the ear and a portion that does not contact the ear.

The acoustic device may be configured not to completely seal the user's external ear canal.

In the acoustic device, the panel may vibrate with an antinode at a central region of the panel and a node on both sides of the antinode, and a location at the central region of the panel may contact the tragus.

In the acoustic device, the panel may vibrate with an antinode at a central region of the panel and a node on both sides of the antinode, and a location at the central region of the panel may contact the antitragus.

The sound-collecting acoustic device may further include a microphone.

In the sound-collecting acoustic device, the vibration unit may generate an external ear canal radiated sound inside the user's ear.

In the sound-collecting acoustic device, the vibration unit may be pressed against the user's ear with a force of 0.1 N to 3 N.

In the sound-collecting acoustic device, the piezoelectric element may be plate-shaped, and the panel may have an area between 0.8 and 10 times an area of a principal surface of the piezoelectric element.

Advantageous Effect

This acoustic device can suppress a loss in sense of volume and sense of comfort.

DETAILED DESCRIPTION

The following describes embodiments of the disclosed device.

Embodiment

Figure 1:
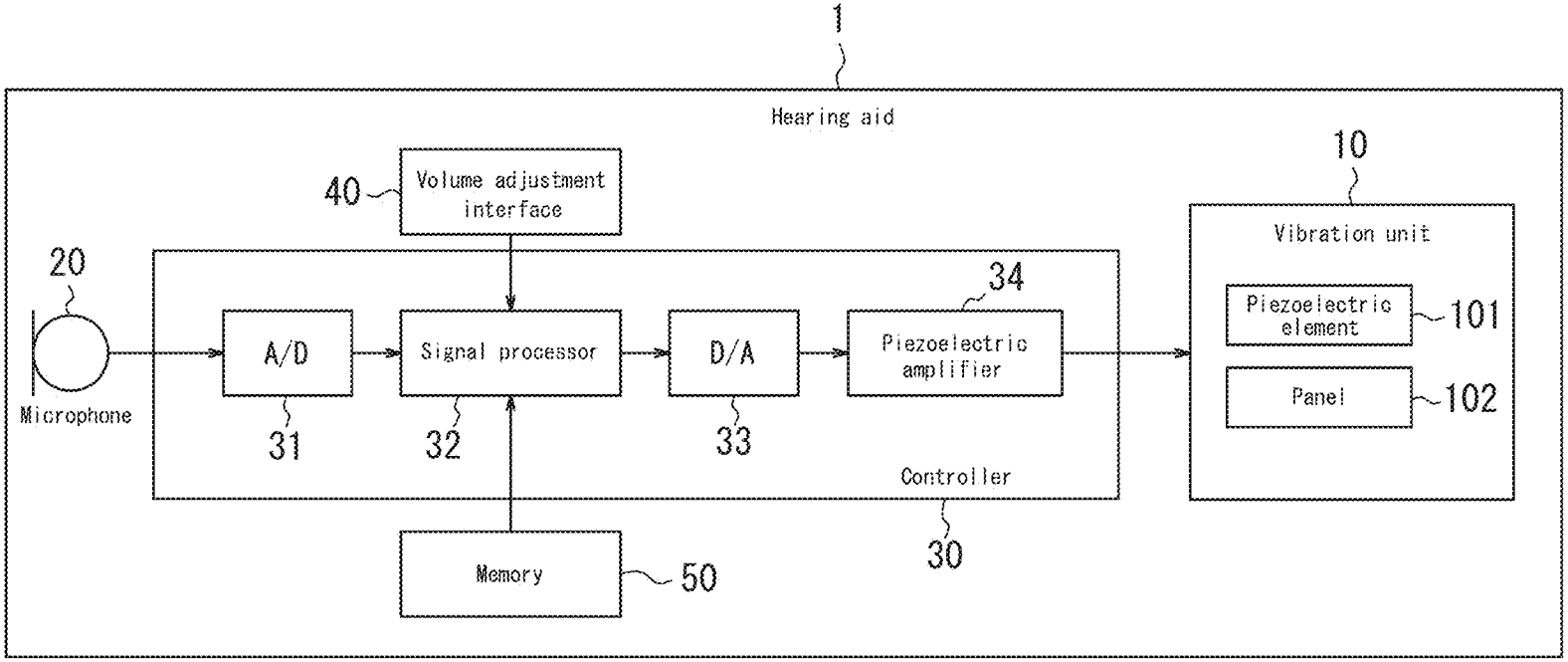
FIG. 1 is a block diagram illustrating a hearing aid according to one of the disclosed embodiments.

FIG. 1 is a block diagram of an acoustic device 1 according to one of the disclosed embodiments. The acoustic device 1 is, for example, a hearing aid 1 and includes a vibration unit 10, a microphone 20, a controller 30, an adjustment interface 40, and a memory 50.

Figure 2:
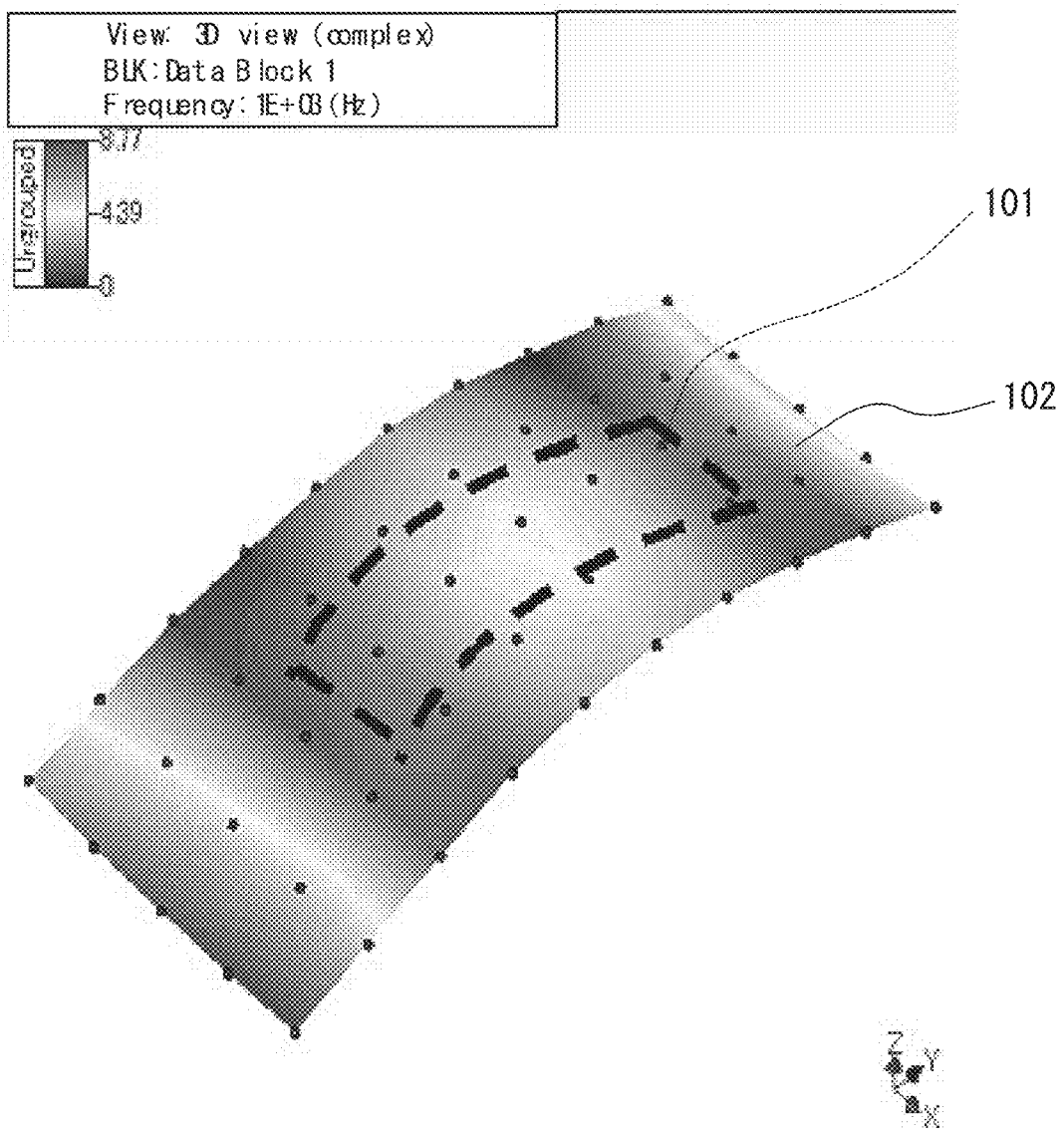
FIG. 2 schematically illustrates flexure of a panel and a piezoelectric element in a hearing aid according to one of the disclosed embodiments.

The vibration unit 10 includes a piezoelectric element 101 that flexes and a panel 102 that vibrates by being bent directly by the piezoelectric element 101. FIG. 2 schematically illustrates flexing of the panel 102 due to the piezoelectric element 101. The vibration unit 10 causes the user to hear air-conducted sound and human body vibration sound due to vibration. Air-conducted sound is sound transmitted to the user's auditory nerve by air vibrations, caused by a vibrating object, that are transmitted through the external ear canal to the eardrum and cause the eardrum to vibrate. Human body vibration sound is sound that is transmitted to the user's auditory nerve through a portion of the user's body (such as the cartilage of the outer ear) that is contacting a vibrating object.

The piezoelectric element 101 is formed by elements that, upon application of an electric signal (voltage), either expand and contract or bend (flex) in accordance with the electromechanical coupling coefficient of their constituent material. Ceramic or crystal elements, for example, may be used. The piezoelectric element 101 may be a unimorph, bimorph, or laminated piezoelectric element. Examples of a laminated piezoelectric element include a laminated unimorph element with layers of unimorph (for example, 16 or 24 layers) and a laminated bimorph element with layers of bimorph (for example, 16 or 24 layers). Such a laminated piezoelectric element may be configured with a laminated structure formed by a plurality of dielectric layers composed of, for example, lead zirconate titanate (PZT) and electrode layers disposed between the dielectric layers. Unimorph expands and contracts upon the application of an electric signal (voltage), and bimorph bends upon the application of an electric signal (voltage).

The panel 102 is, for example, made from glass or a synthetic resin such as acrylic or the like. An exemplary shape of the panel 102 is a plate, and the shape of the panel 102 is described below as being a plate.

The microphone 20 collects sound from a sound source, namely sound reaching the user's ear.

The controller 30 executes various control pertaining to the hearing aid 1. The controller 30 applies a predetermined electric signal (a voltage corresponding to a sound signal) to the piezoelectric element 101. In greater detail, in the controller 30, an A/D converter 31 converts a sound signal collected by the microphone 20 into a digital signal. Based on information on volume, sound quality, and the like from the adjustment interface 40 for volume and sound quality and on information stored in the memory 50, a signal processor 32 outputs a digital signal that drives the vibration unit 10. A D/A converter 33 converts the digital signal to an analog electric signal, which is then amplified by a piezoelectric amplifier 34. The resulting electric signal is applied to the piezoelectric element 101. The voltage that the controller 30 applies to the piezoelectric element 101 may, for example, be ±15 V. This is higher than ±5 V, i.e. the applied voltage of a so-called panel speaker for conduction of sound by air-conducted sound rather than human body vibration sound. In this way, sufficient vibration is generated in the panel 102, so that a human body vibration sound can be generated via a part of the user's body. Note that the magnitude of the applied voltage used may be appropriately adjusted in accordance with the fixation strength of the panel 102 or the performance of the piezoelectric element 101. Upon the controller 30 applying the electric signal to the piezoelectric element 101, the piezoelectric element 101 expands and contracts or bends in the longitudinal direction.

At this point, the panel 102 to which the piezoelectric element 101 is attached vibrates by deforming in conjunction with the expansion and contraction or bending of the piezoelectric element 101. The panel 102 flexes due to expansion and contraction or to bending of the piezoelectric element 101. The panel 102 is bent directly by the piezoelectric element 101. Stating that "the panel 102 is bent directly by the piezoelectric element 101" differs from the phenomenon utilized in known panel speakers, whereby the panel 102 deforms upon vibration of a particular region of the panel 102 due to the inertial force of a piezoelectric actuator constituted by disposing the piezoelectric element 101 in the casing. Stating that "the panel 102 is bent directly by the piezoelectric element 101" refers instead to how expansion and contraction or bending (flexure) of the piezoelectric element 101 directly bends the panel 102 via the joining member.

Since the panel 102 vibrates as described above, the panel 102 generates air-conducted sound, and when the user contacts the panel 102 to the tragus, the panel 102 generates human body vibration sound via the tragus. The panel 102 preferably vibrates with locations near the edges of the panel 102 as nodes and the central region as an antinode, and a location at the central region of the panel 102 preferably contacts the tragus or antitragus. As a result, vibration of the panel 102 can be efficiently transmitted to the tragus or the antitragus.

Figure 3:
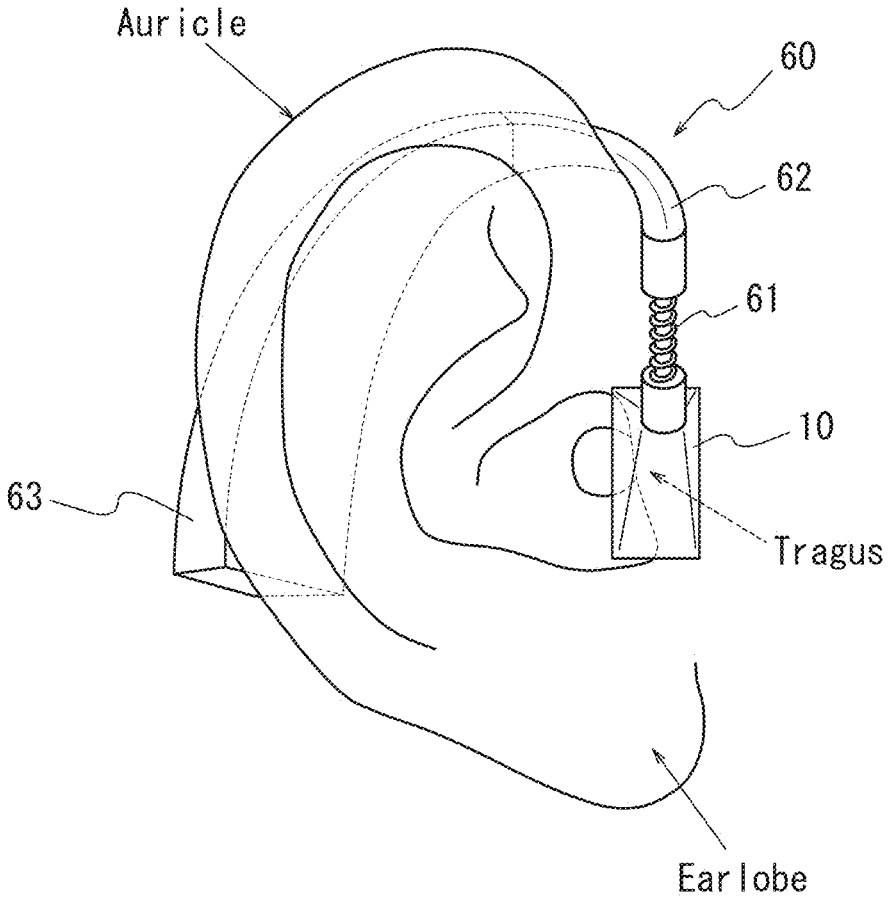
FIG. 3 schematically illustrates the structure of a hearing aid according to one of the disclosed embodiments.
Figure 4:
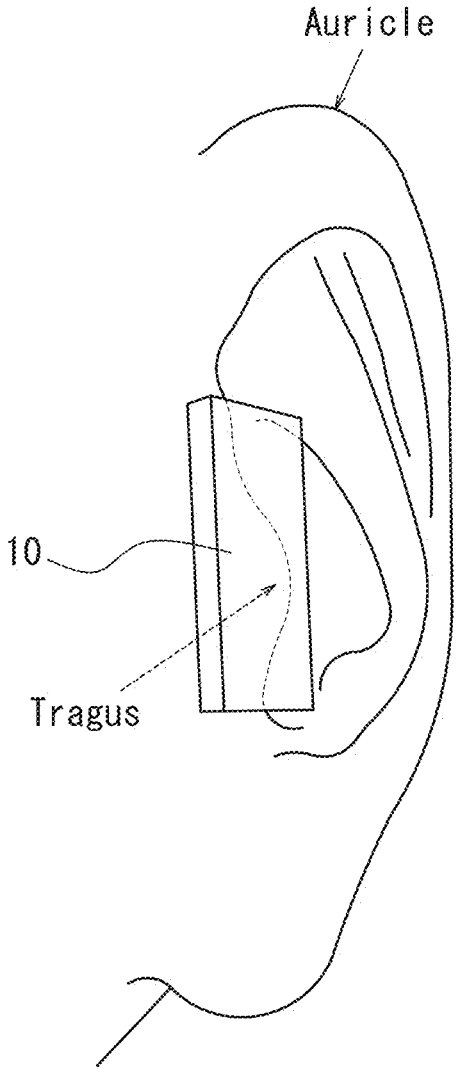
FIG. 4 illustrates the portion of a hearing aid according to one of the disclosed embodiments that is in contact with the tragus.

FIG. 3 schematically illustrates the structure of the hearing aid 1 according to one of the disclosed embodiments. As illustrated in FIG. 3, the vibration unit 10 is contacted to the user's tragus from outside the user's ear. Therefore, a holder 60 is provided. From a different angle, FIG. 4 illustrates the vibration unit 10 in contact with the tragus. As illustrated in FIG. 4, the vibration unit 10 contacts the protruding tragus, and therefore by providing the below-described concavity 104 at the position of contact with the tragus, the area of contact between the vibration unit 10 and the tragus can be sufficiently insured without crushing the tragus. In this embodiment, an example is described in which the position of contact with the user's ear is the tragus.

As illustrated in FIG. 3, the holder 60 includes a support 61, an ear hook 62, and a body 63. The holder 60 holds the vibration unit 10 at the position at which the vibration unit 10 contacts the user's ear (at the tragus). One end of the support 61 is connected to the vibration unit 10. The support 61 has a hollow structure, and a lead wire is fed to the vibration unit 10 through this hollow structure. The support 61 is rigid enough so that the angle of the vibration unit 10 does not change. The other end of the support 61 is connected to one end of the ear hook 62.

The ear hook 62 contacts the outside of the user's auricle to mount the hearing aid 1 in the user's ear. The ear hook 62 is preferably shaped as a hook conforming to the user's auricle so as to mount the hearing aid 1 stably in the user's ear. The other end of the ear hook 62 is connected to the body 63. The body 63 stores the microphone 20, controller 30, adjustment interface 40, and memory 50 therein.

Figure 5:
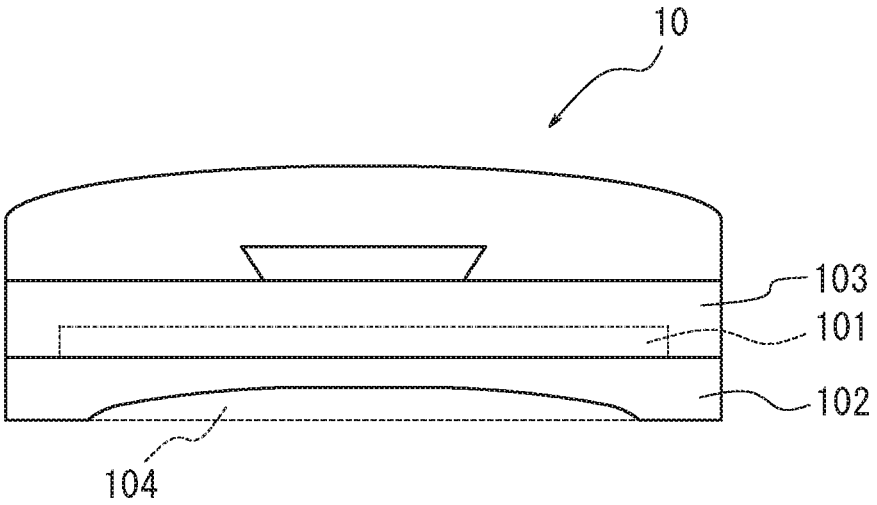
FIG. 5 is a side view in the thickness direction of a vibration unit.

FIG. 5 is a side view of the vibration unit 10 as viewed in the thickness direction. As described above, the vibration unit 10 includes the piezoelectric element 101 and the panel 102. The piezoelectric element 101 is preferably shaped as a plate, as in FIG. 5.

The piezoelectric element 101 is joined to the panel 102 by a joining member. The joining member is disposed between the principal surface of the piezoelectric element 101 and the principal surface of the panel 102. The joining member is preferably a non-heat hardening adhesive material or double-sided tape. Apart from the surface joined to the panel 102, the piezoelectric element 101 is covered by a mold 103.

The principle surface of the panel 102 includes the concavity 104. The concavity 104 is a recessed portion in the central region of the panel 102. Since the tragus projects outward, it is necessary to secure the area of contact by crushing the tragus when contacting a flat surface thereto. Conversely, since the hearing aid 1 includes the concavity 104, and this concavity 104 contacts the tragus, the area of contact can be secured without crushing the tragus. Since it is not necessary to crush the tragus, the holder 60 can have a simple structure. Furthermore, since the tragus is not crushed, a sense of comfort can be maintained when the user wears the hearing aid 1.

The panel 102 of the vibration unit 10 is pressed against the user's ear with a force of 0.1 N to 3 N. If the panel 102 is pressed with a force between 0.1 N and 3 N, vibration by the panel 102 is sufficiently transmitted to the ear. Furthermore, if the pressure is a small force of less than 3 N, the user suffers little fatigue even when wearing the hearing aid 1 for an extended period of time, thus maintaining a sense of comfort when wearing the hearing aid 1.

The concavity 104 of the panel 102 preferably includes a portion that contacts the user's ear (for example, the tragus) and a portion that does not contact the user's ear. By providing a portion that does not contact the user's ear within the panel 102, it may be possible to generate air-conducted sound from this portion.

The principal surface of the panel 102 preferably has an area between 0.8 and 10 times the area of the principal surface of the piezoelectric element 101. If the principal surface of the panel 102 has an area between 0.8 and 10 times the area of the principal surface of the piezoelectric element 101, the panel 102 can deform in conjunction with expansion and contraction or bending of the piezoelectric element 101, and the area of contact with the user's ear can be sufficiently guaranteed. The area of the panel is, for example, more preferably between 0.8 and 5 times the area of the piezoelectric element.

Next, the acoustic characteristics of the hearing aid 1 according to one of the disclosed embodiments are described with reference to FIGS. 6 through 8.

Figure 6:
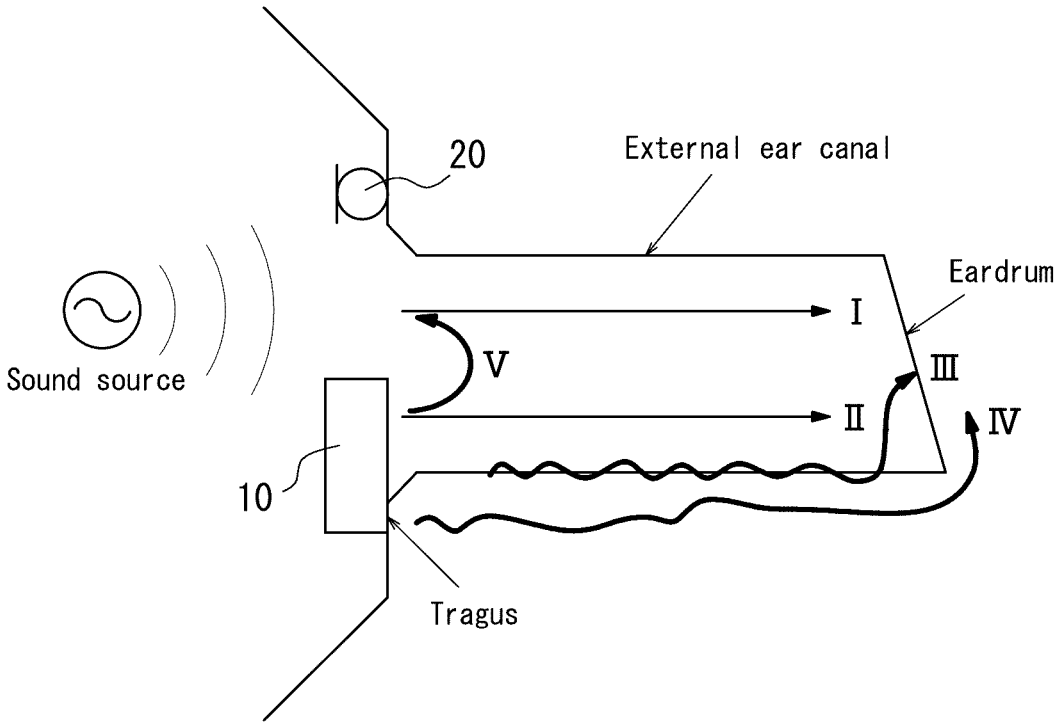
FIG. 6 schematically illustrates transmission of sound from a hearing aid according to one of the disclosed embodiments.
Figure 7A:
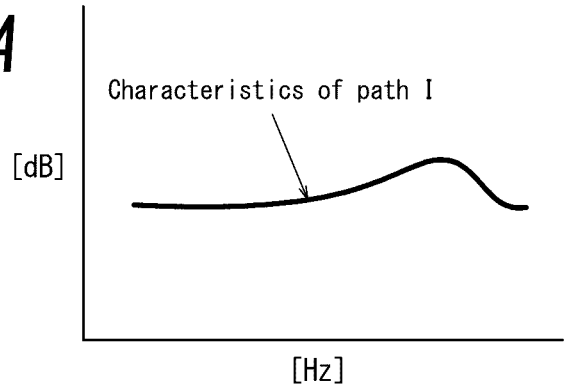
FIGS. 7(*a*) through 7(*d*) schematically illustrate acoustic characteristics of various paths.
Figure 7B:
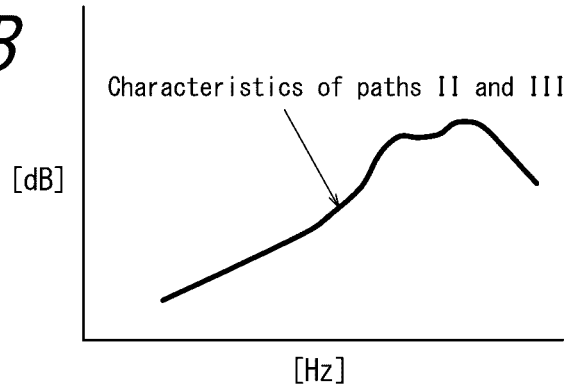
Figure 7C:
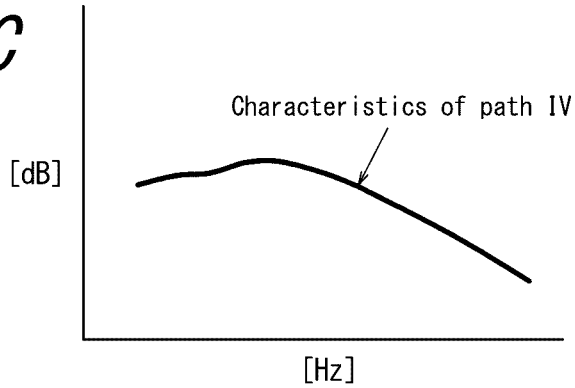
Figure 7D:
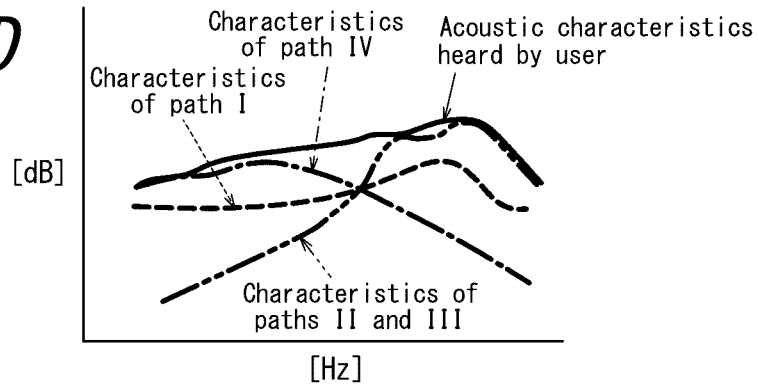

FIG. 6 schematically illustrates transmission of sound from the hearing aid 1 according to one of the disclosed embodiments. In FIG. 6, the only illustrated portions of the hearing aid 1 are the vibration unit 10 and the microphone 20. The microphone 20 collects sound from a sound source. By vibrating, the vibration unit 10 causes the user to hear the sound collected by the microphone 20.

As illustrated in FIG. 6, sound from the sound source passes through the external ear canal from a portion not covered by the vibration unit 10 and reaches the eardrum directly (path I). Air-conducted sound due to vibration of the vibration unit 10 also passes through the external ear canal and reaches the eardrum (path II). Due to the vibration of the vibration unit 10, the external ear canal vibrates, and sound due to this vibration of the external ear canal (external ear canal radiated sound) reaches the eardrum (path III). Furthermore, human body vibration sound due to the vibration of the vibration unit 10 reaches the auditory nerve directly without passing through the eardrum (path IV). A portion of the air-conducted sound produced by the vibration unit 10 escapes to the outside (path V).

FIGS. 7(*a*) through 7(*d*) schematically illustrate the acoustic characteristics of the various paths. FIG. 7(*a*) illustrates the acoustic characteristics of sound by path I, and FIG. 7(*b*) illustrates the acoustic characteristics of sound by path II and path III. For the sound by path II and path III, the sound pressure in the low-frequency sound region is low, since low-frequency sound escapes by path V. FIG. 7(*c*) illustrates the acoustic characteristics of path IV. As illustrated in FIG. 7(*c*), in the human body vibration sound, the sound pressure of low-frequency sound is high, and low-frequency sound can be transmitted well. FIG. 7(*d*) illustrates the acoustic characteristics for a combination of sounds by paths I through IV, i.e. the actual acoustic characteristics heard by a user wearing the hearing aid 1. As illustrated in FIG. 7(*d*), even though sound pressure of low-frequency sound escapes to the outside by path V, the sound pressure of low-frequency sound, namely sound pressure of low-frequency sound at 1 kHz or less in this embodiment, can be guaranteed by the human body vibration sound, thereby maintaining a sense of volume.

Figure 8:
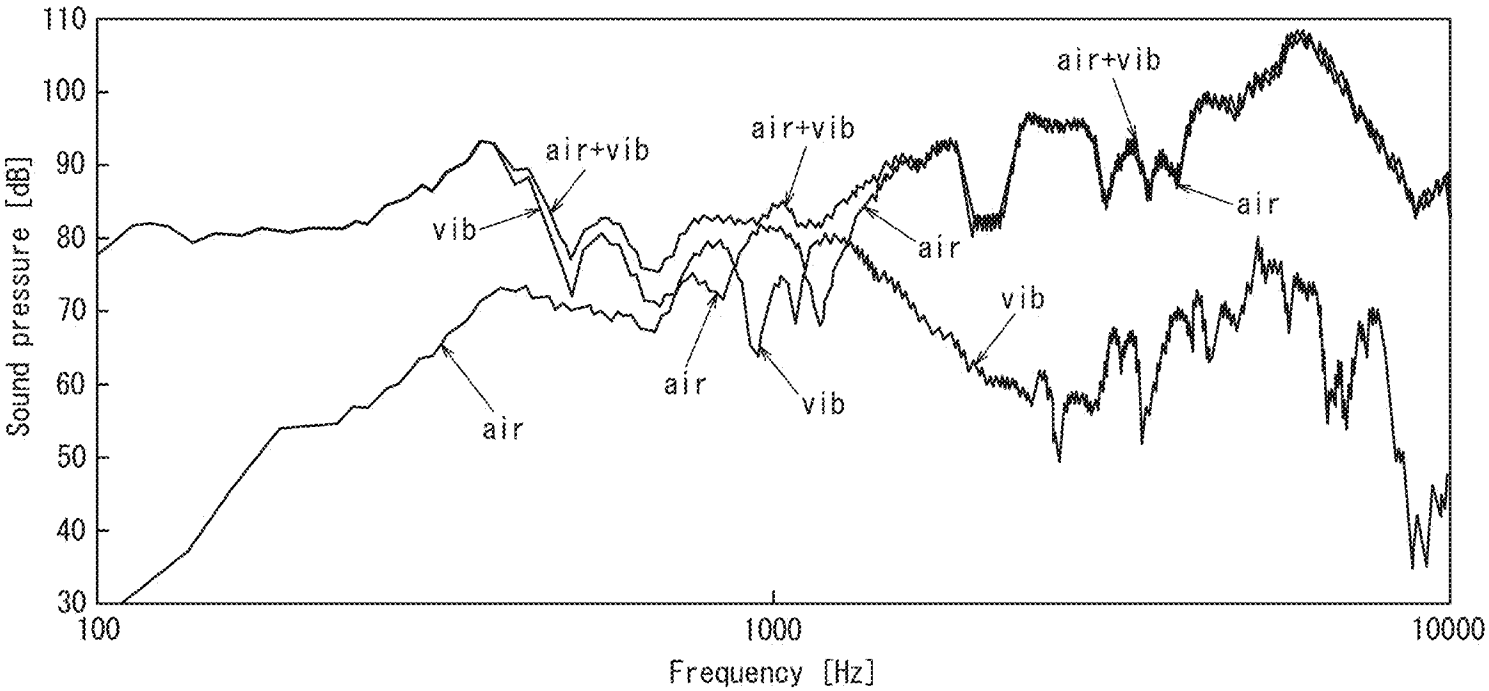
FIG. 8 illustrates measured values of the acoustic characteristics of a hearing aid according to one of the disclosed embodiments.

FIG. 8 illustrates measured values of the frequency characteristics of the hearing aid 1. In FIG. 8, "air" represents the frequency characteristics of sound by path II and path III in FIG. 6, and "vib" represents the frequency characteristics of sound by path IV in FIG. 6. Furthermore, "air+vib" represents the frequency characteristics of sound yielded by combining the sound of path II through path IV. As indicated by these measurement values, the sound pressure of low-frequency sound, namely sound pressure of low-frequency sound at 1 kHz or less in this embodiment, can be guaranteed by the human body vibration sound, thereby suppressing a loss in the sense of volume.

Figure 9A:
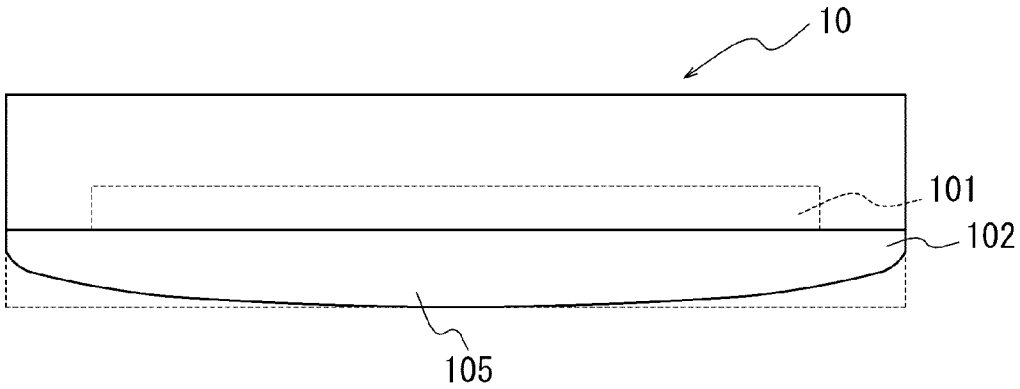
FIGS. 9(*a*) and 9(*b*) illustrate measured values in the case of providing a convexity instead of a concavity.
Figure 9B:
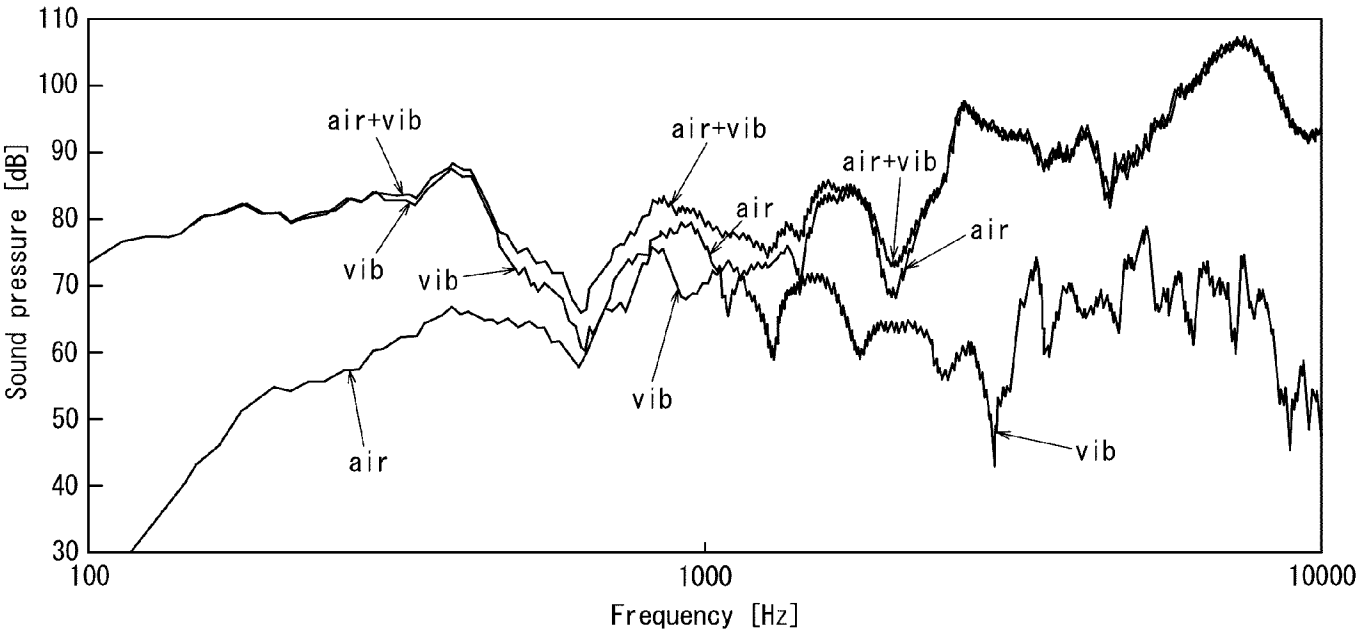
Figure 10:
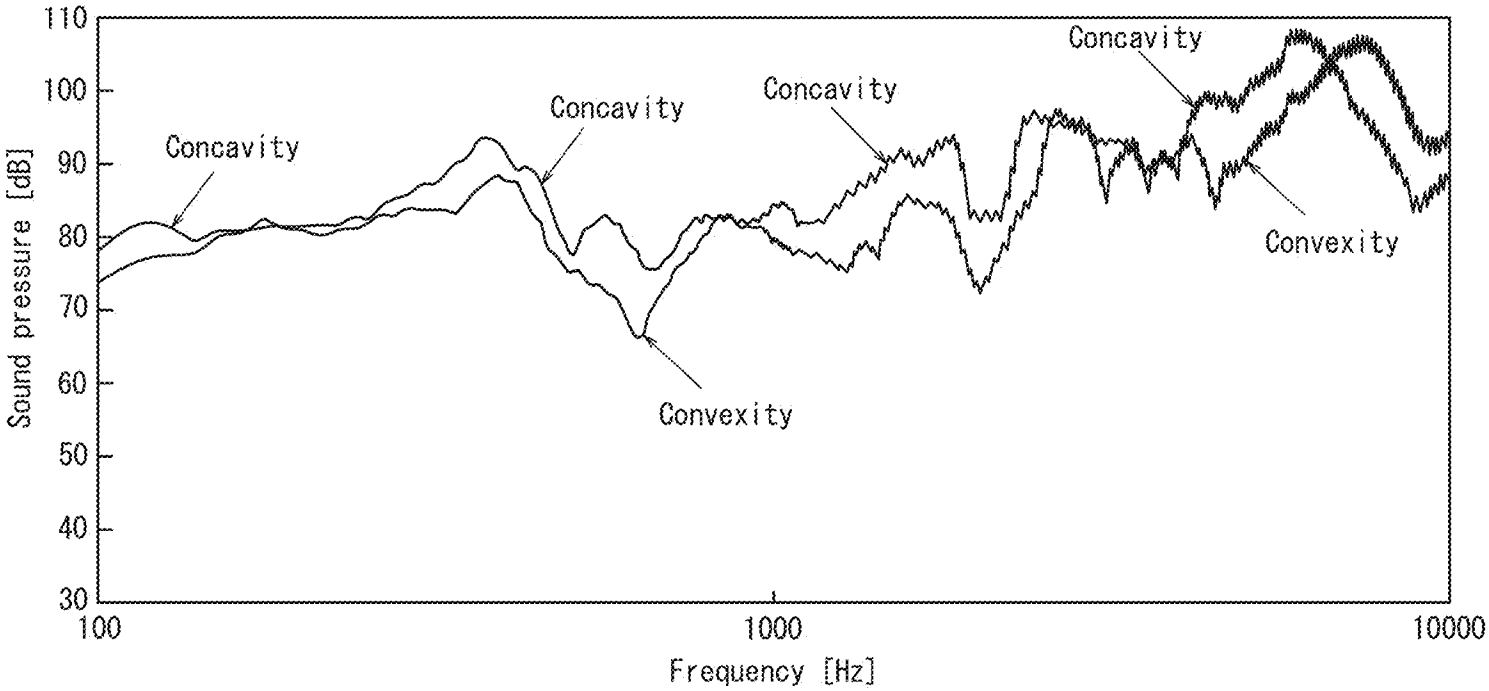
FIG. 10 illustrates a comparison of measured values in the cases of providing a concavity and a convexity.

FIG. 9(*b*) illustrates measured values in the case of providing a convexity 105 instead of the concavity 104 in the panel 102 (FIG. 9(*a*)). In FIG. 9(*b*), "air" represents the frequency characteristics of sound by path II and path III in FIG. 6, and "vib" represents the frequency characteristics of sound by path IV in FIG. 6. Furthermore, "air+vib" represents the frequency characteristics of sound yielded by combining the sound of path II through path IV. FIG. 10 illustrates the frequency characteristics of "air+vib" for each of the cases of providing the concavity 104 and the convexity 105 in the panel 102. As illustrated in FIG. 10, the structure in which the concavity 104 is provided in the panel 102 has a higher sound pressure in numerous frequency ranges, yielding excellent acoustic characteristics.

While an example in which the acoustic device is a hearing aid 1 has been described in this embodiment, this example is not limiting. For example, the acoustic device may be a headphone or earphone, in which case the microphone 20 is not provided. In this case, the acoustic device may reproduce sound based on music data stored in an internal memory of the acoustic device or sound based on music data stored on an external server or the like and transmitted over a network.

In this embodiment, while an example has been illustrated in which the user is caused to hear sound by contacting the vibration unit 10 to the user's tragus from outside the user's ear and transmitting vibration to the tragus, this example is not limiting. For example, the user may be caused to hear sound by contacting the vibration unit 10 to a convex portion, such as the user's antitragus or the crus of antihelix, from outside the user's ear and transmitting vibration thereto. "Contacting to the user's tragus or antitragus from outside the user's ear" refers to contacting the vibration unit 10 to the tragus or antitragus approximately in parallel with the cheek or temple, without burying the vibration unit 10 in the external ear canal.

Although this disclosure is based on embodiments and drawings, it is to be noted that various changes and modifications will be apparent to those skilled in the art based on this disclosure. Therefore, such changes and modifications are to be understood as included within the scope of this disclosure. For example, the functions and the like included in the various units and members may be reordered in any logically consistent way. Furthermore, units and members may be combined into one or divided.

REFERENCE SIGNS LIST

1 Acoustic device (hearing aid)
10 Vibration unit
20 Microphone
30 Controller
31 A/D converter
32 Signal processor
33 D/A converter
34 Piezoelectric amplifier
40 Adjustment interface
50 Memory
60 Holder
61 Support
62 Ear hook
63 Body
101 Piezoelectric element
102 Panel
103 Mold
104 Concavity
105 Convexity

The invention claimed is:

1. An acoustic device for causing a user to hear sound, comprising:

a vibration unit including a piezoelectric element that flexes and a panel that vibrates by being bent directly by the piezoelectric element, wherein the panel includes a concavity, and the concavity is contacted to a user's ear the concavity in the panel contacts the user's tragus from outside the user's ear and transmits vibration of the panel to the tragus, the panel vibrates with an antinode at a central region of the panel and a node on both sides of the antinode, and a location at the central region of the panel contacts the tragus.

2. The acoustic device of claim 1, wherein a principal surface of the panel includes a portion that contacts the ear and a portion that does not contact the ear.

3. The acoustic device of claim 1, wherein the acoustic device does not completely seal the user's external ear canal.

4. The acoustic device of claim 1, further comprising a microphone.

5. The acoustic device of claim 1, wherein the vibration unit generates an external ear canal radiated sound inside the user's ear.

6. The acoustic device of claim 1, wherein the vibration unit is pressed against the user's ear with a force of 0.1 N to 3 N.

7. The acoustic device of claim 1, wherein the piezoelectric element is plate-shaped, and the panel has an area between 0.8 and 10 times an area of a principal surface of the piezoelectric element.

8. An acoustic device for causing a user to hear sound, comprising:

a vibration unit including a piezoelectric element that flexes and a panel that vibrates by being bent directly by the piezoelectric element, wherein the panel includes a concavity, and the concavity is contacted to a user's ear, the concavity in the panel contacts the user's antitragus from outside the user's ear and transmits vibration of the panel to the antitragus, the panel vibrates with an antinode at a central region of the panel and a node on both sides of the antinode, and a location at the central region of the panel contacts the antitragus.

9. The acoustic device of claim 8, wherein a principal surface of the panel includes a portion that contacts the ear and a portion that does not contact the ear.

10. The acoustic device of claim 8, wherein the acoustic device does not completely seal the user's external ear canal.

11. The acoustic device of claim 8, further comprising a microphone.

12. The acoustic device of claim 8, wherein the vibration unit generates an external ear canal radiated sound inside the user's ear.

13. The acoustic device of claim 8, wherein the vibration unit is pressed against the user's ear with a force of 0.1 N to 3 N.

14. The acoustic device of claim 8, wherein the piezoelectric element is plate-shaped, and the panel has an area between 0.8 and 10 times an area of a principal surface of the piezoelectric element.

* * * * *